United States Patent [19]

Green

[11] 4,415,327

[45] Nov. 15, 1983

[54] SPARE BOWLING COMPUTER FOR SPOT BOWLERS

[75] Inventor: Floyd H. Green, Forest Park, Ill.

[73] Assignee: Floyd H. Green, Forest Park, Ill.

[21] Appl. No.: 393,191

[22] Filed: Jun. 28, 1982

[51] Int. Cl.[3] ..... G09B 9/00

[52] U.S. Cl. ..... 434/249

[58] Field of Search ..... 434/249; 235/61 B

[56] References Cited

U.S. PATENT DOCUMENTS

| | | |
|---|---|---|
| 2,934,837 | 5/1960 | Dell . |
| 2,942,358 | 6/1960 | Pomranz . |
| 2,989,810 | 6/1961 | Marting . |
| 3,012,339 | 12/1961 | Peterson . |
| 3,081,559 | 3/1963 | Kaminsky . |
| 3,279,097 | 10/1966 | Tomblin . |
| 3,284,928 | 11/1966 | Kelley . |
| 3,374,557 | 3/1968 | Lotarius . |
| 3,455,032 | 7/1969 | Vail . |
| 3,995,377 | 12/1976 | Grollmusz . |
| 4,035,931 | 7/1977 | Burger . |

*Primary Examiner*—Harland S. Skogquist
*Attorney, Agent, or Firm*—Philip H. Kier

[57] ABSTRACT

A computer device for assisting spot bowlers to determine starting position and direction in which to bowl a ball to collide with a predetermined pin or group of pins, comprising two coextensive, rectangular members. On one member, a representation of a bowling lane with appropriate markings is obversely displayed. The other member is transparent and contains a bowling ball indicator that is concentric with the five-pin location spot when the two members are aligned. The invention is calibrated by aligning the two members and for a strike ball tracing a straight line from the starting position of the proper foot to the target over which the ball passes on the transparent member. By adjusting the relative positions of the two members such that the bowling ball indicator approaches the required pin from the appropriate direction, a spot bowler by noting the location and direction of the calibration line will be aided in choosing a starting position and a spot at which to aim the ball in attempting to pick up a spare.

5 Claims, 6 Drawing Figures

SPARE BOWLING COMPUTER FOR SPOT BOWLERS

BACKGROUND OF THE INVENTION

This invention is a computer device to aid a spot bowler choose a starting position and a direction to roll the second ball in a frame to achieve a spare. The terms, "strike", "spare", "frame" are widely-used bowling parlance and need no further explanation to practitioners of the sport of bowling to whom this invention is of interest.

There have been several patents issued for inventions for aiding a bowler improve his or her game. Because of the nature of the objective of these inventions, they all contain common features such as a representation of a bowling lane and a means of assisting a bowler choose a starting position and a direction to roll the ball so that the required group of bowling pins will be knocked down to achieve a spare. Several of the inventions, for example, Pomranz in U.S. Pat. No. 2,942,358, Peterson in U.S. Pat. No. 3,012,339, Tomblin in U.S. Pat. No. 3,279,097, or Burger in U.S. Pat. No. 4,035,931 teach the use of means that require the user to represent the path of a bowled ball in some detail. Other inventions, such as Marting in U.S. Pat. No. 3,989,810 teach means that are complicated in structure. Still other inventions, such as Dell in U.S. Pat. No. 2,934,837, teach the use of means that may be accurate only if the ball is bowled with a path that has only slight curvature.

The present invention is readily and inexpensively fabricated and is very easy to use. From the trajectory of a bowled ball that achieves a strike, a straight line is traced on a transparent member that has a bowling ball indicator in the pin deck area. This calibrates the device. The relative position of the transparent member and a member that has a representation of a bowling lane are adjusted so that the bowling ball indicator has the proper approach to a bowling pin sought to be struck. The position of the calibration line will then indicate the starting position and the spot on the array of targets at which to aim.

SUMMARY OF THE INVENTION

The invention essentially comprises two unattached members. One of the members has a representation of a bowling lane with appropriate markings. The second member, which is coextensive with the first member and is transparent, contains a bowling ball indicator that is circular in shape and is concentric with the five-pin location spot on the first member when the two members are aligned. Because a ball that achieves a strike will pass over or very close to the five-pin spot, the bowling ball indicator is used as the terminus of the path of a ball bowled by the user.

A spot bowler bowls toward a spot on the alley, usually one of the targets in a V-shaped array, from a given starting point. The starting point and the spot to which he or she bowls will depend on the pin or combination of pins the bowler seeks to strike. A spot bowler will bowl a ball with the same shaped trajectory to pick up a spare as to achieve a strike. Thus a straight line traced from the starting position to the spot in the target area together with the bowling ball indicator will sufficiently represent the trajectory of a ball on a given lane. The invention is calibrated by tracing a straight line from the starting position to the spot in the target array through which a strike ball is bowled when the two members are aligned. To aid a spot bowler to pick up a spare, the relative positions of the two members are manually adjusted such that the bowling ball indicator approaches the location spot of the desired pin from the proper direction. The calibration line will then indicate the starting position and the spot on the alley through which the ball should be bowled.

DETAILED DESCRIPTION OF THE INVENTION

The present invention has two unattached parts: a base member A and a cover member B. The base member is rectangular in shape with the same ratio of length to width as that of a regulation bowling lane. The particular dimensions should be such that a physical embodiment of the invention is readily carried and used. A length of approximately 20 centimeters is appropriate for an embodiment that can be carried in a pocket but yet is sufficiently wide for a calibration line that represents the path of a ball to be traced accurately. Obversely visable on the base section is a representation of markings of a bowling lane with the regulation spaced relationships.

Figure 1:
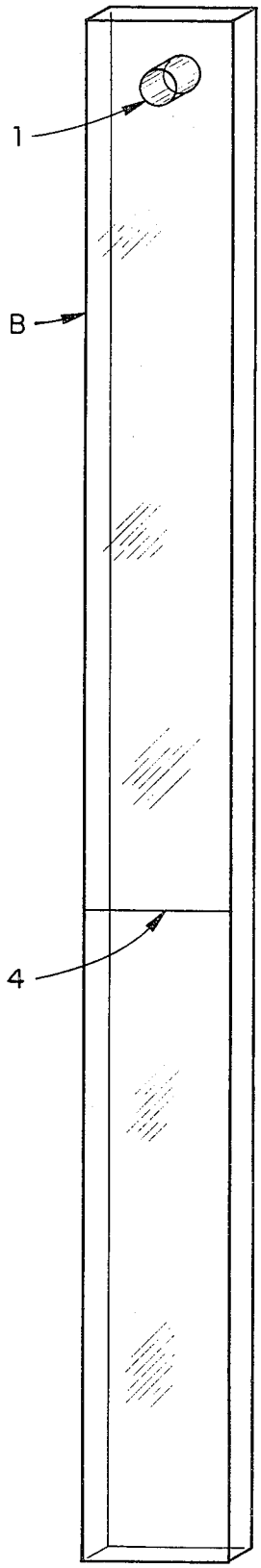
FIG. 1 is a perspective view of the transparent cover member.
Figure 2:
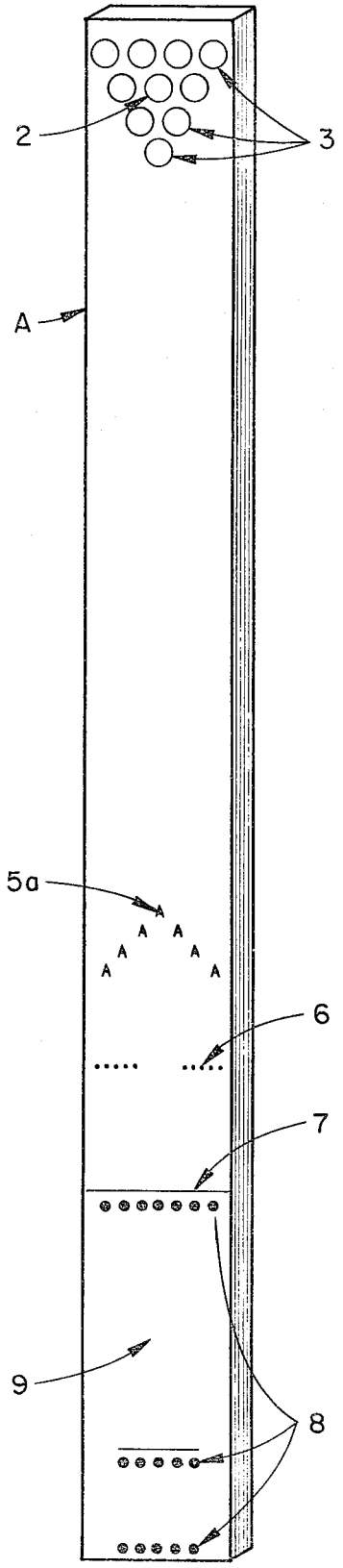
FIG. 2 is a perspective view of the base member showing a representation of a bowling lane with markings.
Figure 3:
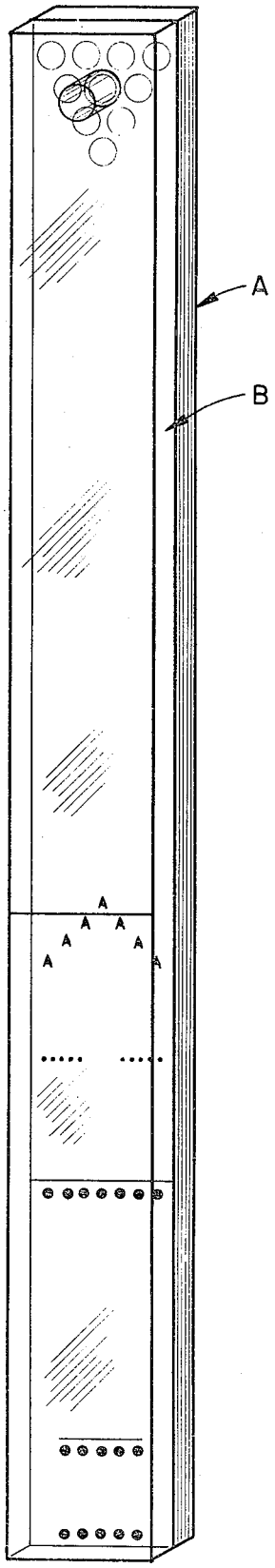
FIG. 3 shows the two members in alignment with the bowling ball indicator over the five-pin location spot.

With reference to FIGS. 2 and 3, the representation of markings on the preferred embodiment should include the following. There should be a triangular array of ten bowling pin location spots 3, with the five-pin location spot shown as 2. It is preferred that the diameter of the bowling pin location spots be to the scale of the maximum diameter of a bowling pin rather than to the scale of the pin spot on a lane. There is a V-shaped array of the seven targets 5, the center lead target being shown as 5*a*. These targets may be represented as dowels, darts, diamonds, triangles or rectangles. There is a transverse line, representing the foul line that divides a lane into an alley section and an approach section 9. There may be three sets of guide spots 8 in the approach section, each set in a transverse line. One set is immediately adjacent to the foul line 7 and another set is immediately adjacent to the edge of the lane. The guide spots near the foul line, seven in number, the targets, and the bowling pin location spots should be longitudinally aligned. There may be an additional transverse set of guide spots 6 between the foul line and the and the targets.

The cover member B should have the same length and width as the base member A and should be transparent. The cover member has a hole or circle 1 that serves as a bowling ball indicator and has a diameter that is to the scale of a bowling ball. The bowling ball indicator is located such that it is concentric with the five-pin location spot 2 when the cover member and the base member are aligned, as shown in FIG. 3. The cover member may also have a transverse line 4, the target line, that passes immediately to the bowling pin array side of the lead target 5*a* when the two members are aligned.

The principle of operation is based on the fact that most spot bowlers bowl a ball with the same shaped trajectory to pick up a spare as to achieve a strike. What is changed is the starting position and the direction in which the ball is thrown. The principle of operation is also based on the observation that when a strike ball is thrown, its trajectory will pass very close to the center of the five-pin location spot 2. It is recognition of these observations that provides the novel features of this invention.

Figure 4:
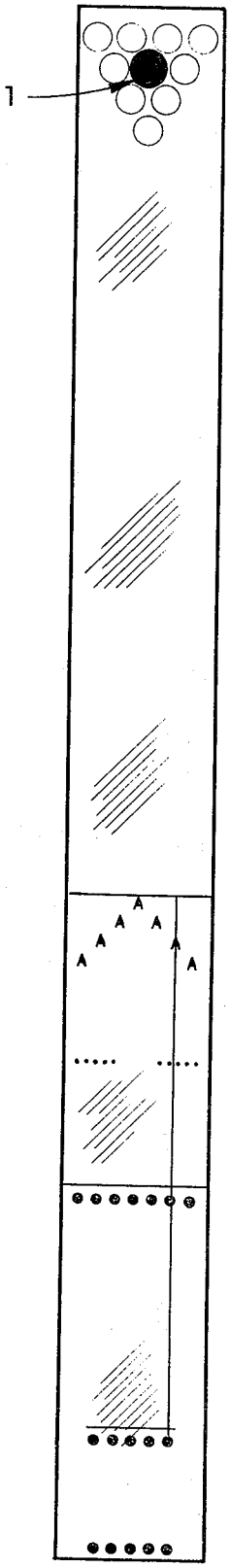
FIG. 4 shows the invention calibrated for a right-handed bowler whose ball's path curves or hooks to the left.

The invention is calibrated for a given lane as follows. The base member and the cover member are aligned. The bowler throws practice balls until a strike is thrown. The bowler notes over or near which target the ball passed and the starting position of his or her right foot if right-handed or left foot if left-handed. The bowler then traces the trajectory of the strike ball on the cover member with an erasable marker pen or pencil. Because the bowling ball indicator 1 can be considered the end of the trajectory, it need not be traced in its entirety nor precisely. All that need be traced is a straight line extending from the starting position of the appropriate foot, through the target array 5 to the target line 4. FIG. 4 illustrates the calibration for a right-handed bowler who bowls a ball that curves or hooks to the left.

To aid a bowler to choose where to stand when beginning the approach to the foul line and in which direction or to what spot to aim the ball to pick up a spare, the cover member is rotated and translated relative to the base member such that the bowling ball indicator 1 is adjacent to the representation of the pin sought to be struck and is at the proper angle relative to that pin. Then the direction of the trace made during the calibration and where it crosses the target array will indicate to the bowler the spot at which to aim when the ball is bowled. The other end of the trace will indicate the position of the proper foot when beginning the approach. In league play a bowler bowls on two adjacent lanes. As the calibration may vary from lane to lane, two cover members may easily be used with the same base member.

Figure 5:
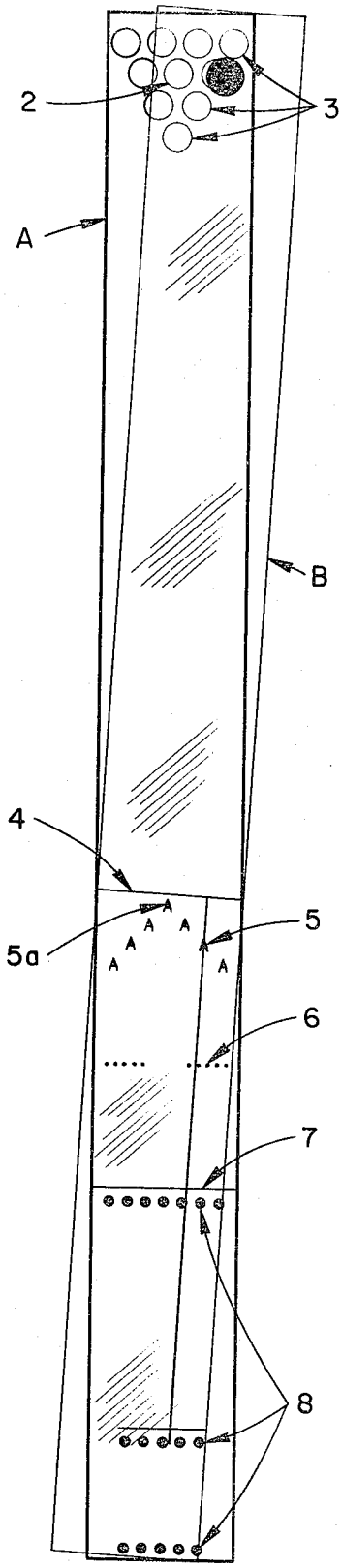
FIG. 5 shows the relative position of the two members for hitting the ten-pin head-on for the calibration given in FIG. 4.
Figure 6:
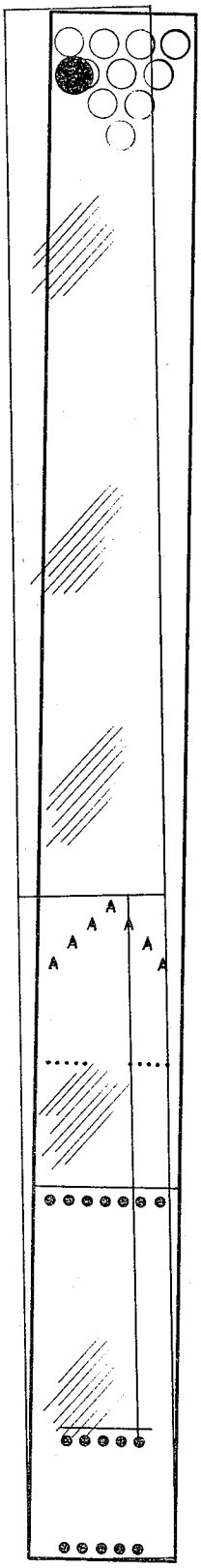
FIG. 6 shows the relative position of the two members for hitting the seven-pin head-on for the same calibration.

FIG. 5 illustrates the relative positions of the two members for the bowler whose strike ball calibration trace is illustrated in FIG. 4 to aim to hit the ten-pin head-on. FIG. 6 illustrates the relative positions of the two members for the same bowler to aim to hit the seven-pin head-on.

While a particular embodiment of the present invention has been shown and illustrated, it is to be understood that I intend to limit my invention solely by the scope of the appended claims.

I claim:

1. A two-member bowling computer to assist a spot bowler to locate his or her feet and to project a bowling ball in a direction to hit a selected pin or group of pins, the combination comprising:

a rectangular base member having the same ratio of length to width as that of a regulation bowling lane;

a representation of a bowling lane obversely visable on the base member, said bowling land representation including ten bowling pin location spots deployed in a triangular array, a transverse line indicating a foul line that divides a bowling lane into an approach section and an alley section, seven target indicators deployed in a V-shaped array in the alley section;

an optically transparent cover member that is spatially coextensive with the base member and that has a bowling ball indicator that is concentric with the location spot of the five-pin when the base member and the cover member are aligned.

2. The invention as defined in claim 1, wherein the diameter of each bowling pin location spot and the diameter of the bowling ball indicator have the the relation to the maximum diameter of a bowling pin and to the diameter of a bowling ball respectively, as the dimensions of the base member have to the dimensions of a bowling lane.

3. The invention as defined in claim 2, wherein the cover member includes a transverse line that extends immediately to the bowling pin array side of the target array when the base member and the cover member are aligned.

4. The invention as defined in claim 3 wherein the representation of a bowling lane further includes in the approach section three sets of guide marks; each set containing a plurality of guide marks deployed in a transverse line, one set being immediately adjacent to the line representing the foul line and another set being immediately adjacent to the edge of the base member.

5. The invention as defined in claim 4 wherein the representation of the bowling lane further includes a set of guide marks in the alley section, said fourth set of guide marks being deployed in a transverse array and being located between the target array and the line representing the foul line.

* * * * *